US005224361A

United States Patent [19]

Fucík

[11] Patent Number: 5,224,361

[45] Date of Patent: Jul. 6, 1993

[54] THREAD CUTTER FOR DOUBLE-CYLINDER CIRCULAR KNITTING MACHINES

[75] Inventor: Milan Fucík, Kojetice na Moravě, Czechoslovakia

[73] Assignee: Uniplet a.s., Trebic, Czechoslovakia

[21] Appl. No.: 890,532

[22] Filed: May 28, 1992

[30] Foreign Application Priority Data

Jun. 7, 1991 [CS] Czechoslovakia ..... 1752-91

[51] Int. Cl.[5] ..... D04B 35/00

[52] U.S. Cl. ..... 66/140 R; 66/145 R

[58] Field of Search ..... 66/14, 140 R, 145 R, 66/134, 142, 146

[56] References Cited

U.S. PATENT DOCUMENTS

| | | | |
|---|---|---|---|
| 1,945,971 | 2/1934 | Gagne | 66/145 R |
| 2,970,460 | 2/1961 | Mahler et al. | 66/140 R |
| 3,225,571 | 12/1965 | Mahler | 66/145 R |
| 3,496,738 | 2/1970 | Conti | 66/140 R |
| 3,739,602 | 6/1973 | Haas | 66/145 R X |
| 4,085,598 | 4/1978 | Minton | 66/145 R |

FOREIGN PATENT DOCUMENTS 0426030 10/1990 European Pat. Off. .

*Primary Examiner*—Clifford D. Crowder
*Assistant Examiner*—John J. Calvers
*Attorney, Agent, or Firm*—Notaro & Michalos

[57] ABSTRACT

Thread used in double-cylinder circular knitting machines is cut by locating a stationary cutting knife near a space between the cylinders. A saw having perpendicularly arranged teeth is positioned on an outer ring at the top of one of the cylinders. Thread guides move the thread from a pneumatic nozzle to the teeth of the saw. The saw engages the thread and moves the thread for knitting to needles on the cylinder. The saw continues to move the thread from the nozzle to the knife in order to be severed. After severing, the guide is returned and the thread engaged between the needles is disengaged and taken by the saw to the knife to be cut and taken in by the nozzle.

1 Claim, 1 Drawing Sheet

THREAD CUTTER FOR DOUBLE-CYLINDER CIRCULAR KNITTING MACHINES

FIELD AND BACKGROUND OF THE INVENTION

The invention relates to a thread cutter designed for being used in double-cylinder circular knitting machines for hosiery manufacture, the cutter comprising a circular cutter saw and a cutter knife associated therewith.

It is known that for cutting and arresting thread in double-cylinder circular knitting machines for manufacturing hosiery mechanical cutters are used. Such a cutter consists of a body on which a stationary blade or cutting edge is formed, and individual cutting blades which are mounted for perpendicular reciprocation relative to said edge. From above said cutting blades are associated with holding fingers which are arranged either pivotally or stationary. The cutting blades are controlled to move in synchronization with the motion of thread guides between their operative and inoperative positions. During the guide motion to the inoperative position, the cutter is at first open whereupon the inserted thread is cut by moving the blade against the edge and the thread remains arrested by the holding finger. Such devices, however, have some drawbacks such as their complexity in that there can be trouble with removing clippings and, particularly, difficulties encounter when cutting and holding or arresting threads of different thickness by the same cutting blade.

SUMMARY OF THE INVENTION

It is an object of the present invention to eliminate the disadvantages of the prior art as hereinabove referred to and to provide an improved thread cutter wherein the cutting saw is provided on an outer surface of one of its needle cylinders.

The advantage of the invention resides particularly in the simplicity and reliability of the cutter in the thread cutting process.

BRIEF DESCRIPTION OF THE DRAWINGS

In order that the invention be better understood and carried into practice, a preferred embodiment thereof will hereinafter be described with reference to the accompanying schematic drawing in which.

DESCRIPTION OF THE PREFERRED EMBODIMENT

Figure 1:
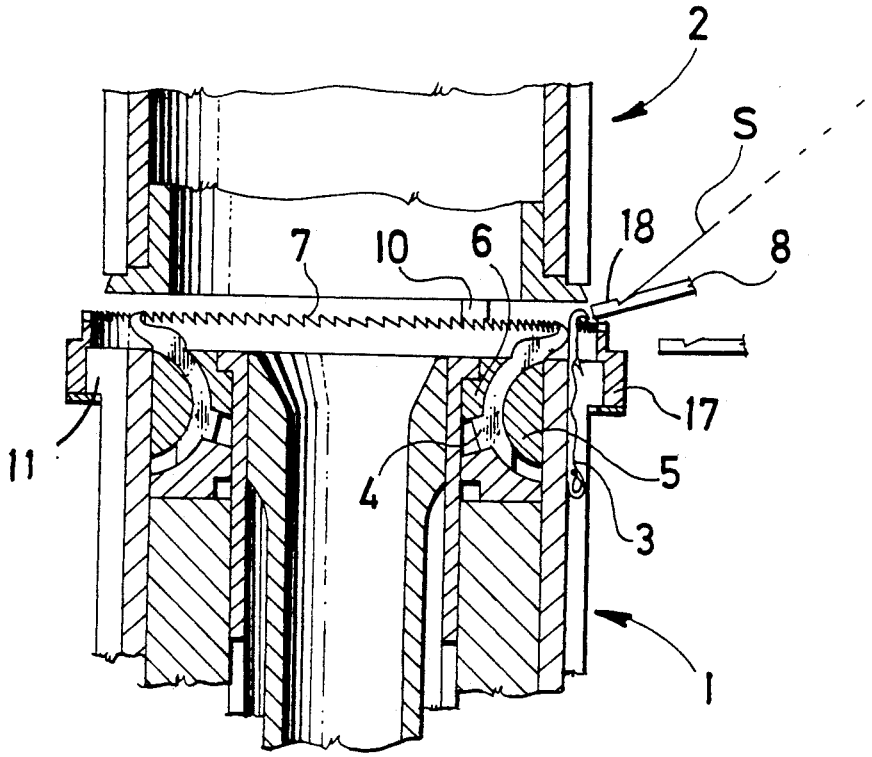
FIG. 1 is an axial sectional view of the two needle cylinders, showing the arrangement of cutting saw on the lower cylinder.

As it can be seen from the drawings, and particularly in FIG. 1 thereof, a well-known double-cylinder circular knitting machine for manufacturing hosiery and the like, is equipped with a lower needle cylinder 1 and an upper needle cylinder 2. In said needle cylinders 1 and 2, respectively, are mounted double-headed needles 3 which are held by means of well-known needle guiding sinkers either in the lower or the upper needle cylinder 1, 2, respectively, depending upon the machine program. In operation, the needles 3 collaborate with well-known knock-over sinkers 4 mounted for reciprocation in grooves of a sinker ring 5, and controlled by stationary sinker cam rings 6.

Figure 2:
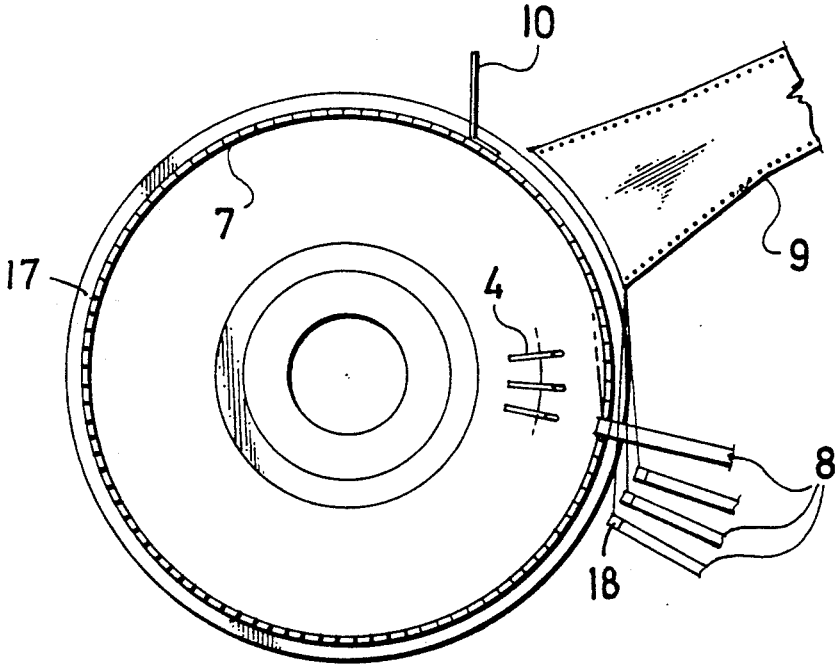
FIG. 2 is a top view of the lower needle cylinder together with the cutting saw, stationary knife and pneumatic nozzle for arresting the cut-off thread ends, as well as with thread guides.

To the top end of the lower needle cylinder 1 there is fixedly attached a circular cutting saw 7 whose teeth are oriented perpendicularly to and above the knock-over plane. Saw 7 engages shoulder 11 of cylinder 1 and is secured to cylinder 1 by saw ring 17. In the knitting system region there are provided thread guides 8 mounted for swinging perpendicularly and moreover for moving radially to the needle cylinders 1, 2. Apart from this, a pneumatic nozzle 9 is provided adjacent the needle cylinders 1, 2 in the thread take-off direction, the mouth of said nozzle being oriented along said cylinders 1, 2 (FIG. 2). Downstream of the pneumatic nozzle 9 the cutting saw 7 is associated with a stationary cutter knife 10. The knife 10 is located near the saw 7 for severing thread S and can be fixed to a stand (not shown).

In operation, as seen in FIG. 2, the thread guide 8 close to the pneumatic nozzle 9 is in its operative position i.e. guide 8 is above saw: and lays thread S in the needles 3. Threads S from other guides 8 are sucked in the nozzle 9. If the threads S or the thread guides 8, respectively, are to be changed, the guide 8 by which the thread S has been torn off, will be displaced so that its end portion—as can be seen in FIG. 1—gets into the lower, inoperative position. The thread S is engaged by the tooth of the cutting saw 7 and carried along by it up to the stationary knife 10 to be severed. The cut-off end is then sucked into the pneumatic nozzle 9.

The thread guide 8 by which thread S has not been laid in, is then displaced into operative position while thread S extending from the nozzle 9 to the guide end is engaged again by the saw tooth, pulled out from the nozzle 9 and finally cut off by the knife 10.

The thread guide 8 has a mouth 18 for supplying thread S. Thread guide 8 follows a curvilinear path in a vertical plane. Thus if the guide 8 moves from the inoperative position i.e., its mouth 18 is below the saw 7 into the operative position i.e., the mouth 18 is above saw 7 as shown in FIG. 1, then the thread S, extended between said mouth 18 and the nozzle 9, gets engaged by the saw teeth 7. The guide 8 will then reach its operative position while the thread is carried along by the saw 7 to the knife 10 where it is severed. However, before thread S is cut off, the thread S extended between the guide 8 in the operative position and the tooth 7, intersects the needles 3 by which the engagement forms a stitch. A length of thread S tensioned between the saw tooth 7 and the nozzle 9 is withdrawn out of the nozzle 9 till it is cut off on the knife 10. When the guide 8 moves from the operative to the inoperative position, the thread S is first disengaged from the needles 3 and then engaged by the saw tooth 7 which will carry it along toward the knife 10 where it is severed. The cut off end portion of thread S is then sucked in by the nozzle 9.

The saw 7 is not engaged by knock-over sinkers 4 due to the position of the sinkers 4 ensured by the cam ring 6. The saw 7 does not come into contact with the thread guide 8 but only with thread S. The operating position of said guide 8 as well as its motion into this position and the inoperative position is along an archway controlled by a thread guide controlling means which ensures both the vertical and radial directions.

During any next change, the threads are cut in this way. Within the invention scope, it is also possible to provide also the upper needle cylinder 2 with the cutting saw 7. In this case, however, the inoperative position of thread guides would not be below but above the knock-over plane, in a mirror image situation relative to the shown one.

I claim:

1. A thread cutter for a double-cylinder circular knitting machine for manufacturing hosiery, at least one cylinder having at least one needle for knitting yarn a top portion of one cylinder located near the top portion of another cylinder forming a space therebetween, the cutter comprising:

a saw concentrically fixed to one of the cylinders at an outer ring, outside of the cylinder and in the space, the saw having a plurality of teeth arranged perpendicular to a knock-over plane of the cylinder below the saw, the outer ring rotatable about the top portion of the cylinder for moving the saw around cylinder;

a stationary cutting knife located near the space of the cylinders for cutting thread;

a pneumatic nozzle located near the space for taking in yarn; and a plurality of yarn guides movably mounted to the machine near the space of the cylinders for carrying yarn from the nozzle to an operative position above the knock-over plane by moving the yarn from the nozzle to the space for engagement by the teeth of the saw, the saw rotating the yarn to the needle for engaging the thread with the needle and for forming a stitch, the saw continuing to rotate the yarn to the knife after engagement of the needle, the saw rotating the yarn to the knife cutting the yarn, the yarn guide moving to an inoperative position below the knock-over plane and away from the saw after the yarn has been cut, the yarn disengaging from the needle and engaging the saw as the yarn guide moves to the inoperative position, the saw moving the disengaged yarn for cutting by the knife, the knife cutting the disengaged thread for forming a cut end of the thread, the cut end of the thread taken in by the nozzle.

* * * * *